US006194626B1

(12) United States Patent
Vora et al.

(10) Patent No.: US 6,194,626 B1
(45) Date of Patent: Feb. 27, 2001

(54) PROCESS FOR THE PURIFICATION OF A DIOLEFIN HYDROCARBON STREAM FROM A NAPHTHA STEAM CRACKER

(75) Inventors: Bipin V. Vora, Naperville; Paul R. Cottrell, Arlington Heights, both of IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/455,424

(22) Filed: Dec. 6, 1999

(51) Int. Cl.[7] ..... C07C 7/163; C10G 69/06

(52) U.S. Cl. ..... 585/326; 585/264; 585/311; 585/314; 585/315; 585/613; 585/615; 208/50

(58) Field of Search ..... 585/311, 314, 585/315, 326, 601, 613, 615, 259, 264; 208/50, 145, 67

(56) References Cited

U.S. PATENT DOCUMENTS 3,634,536 1/1972 Frevel et al. ..... 260/681.5 R
4,440,956 4/1984 Couvillion ..... 585/260
5,981,818 * 11/1999 Purvis et al. ..... 585/519

* cited by examiner

*Primary Examiner*—Bekir L. Yildirim
(74) *Attorney, Agent, or Firm*—John G. Tolomei; John E. Spears, Jr.; John C. Cutts, Jr.

(57) ABSTRACT

A cyclic process for the purification of a diolefin hydrocarbon stream produced in a naphtha steam cracker to produce a high quality diolefin hydrocarbon stream having extremely low levels of acetylene over an extended period because of the ability to readily cyclically regenerate catalyst contained in an off-line selective hydrogenation reaction zone. The spent or partially spent catalyst is contacted with a stream containing naphtha and hydrogen to restore at least a portion of the fresh catalyst activity by the extraction of polymer compounds therefrom.

7 Claims, 1 Drawing Sheet

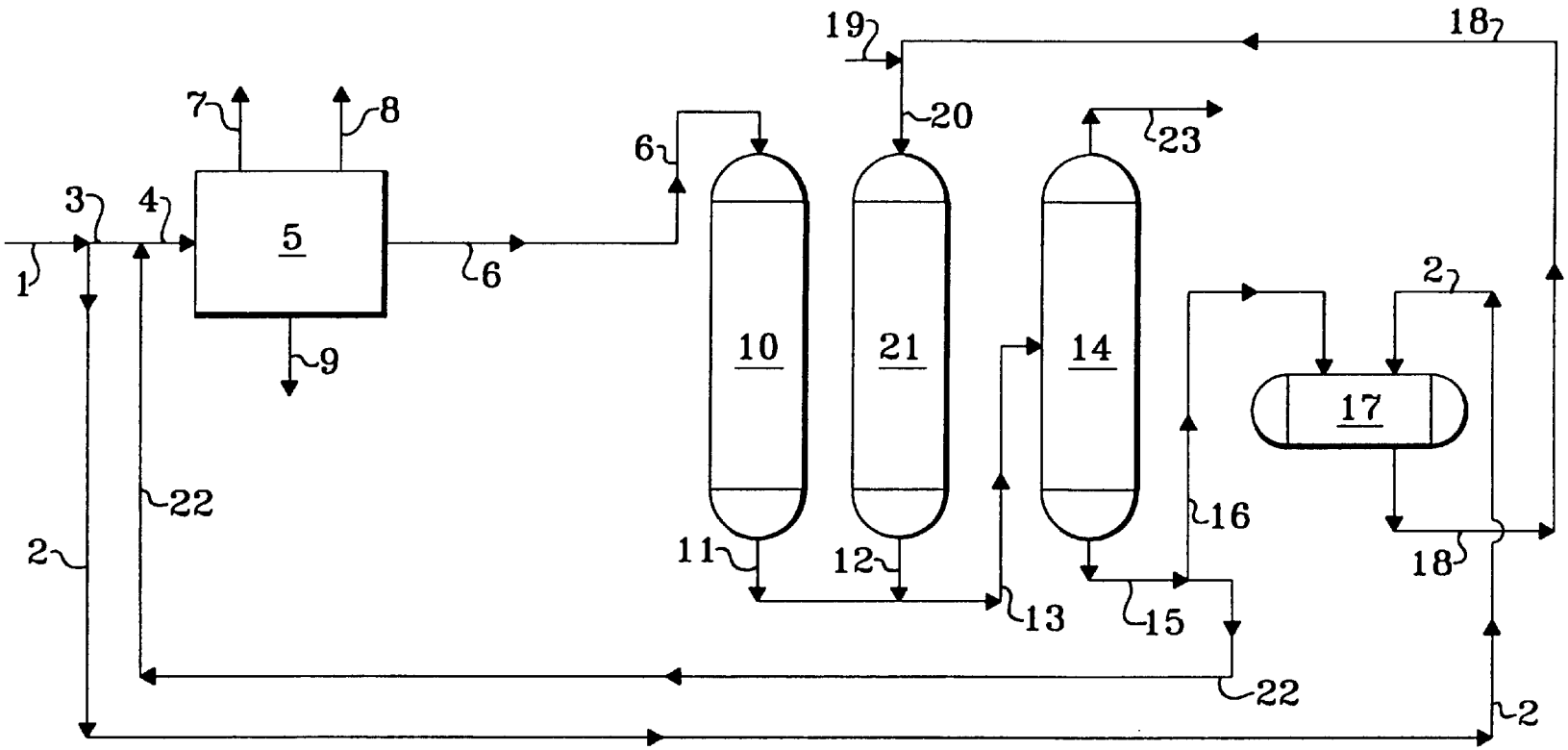
1
2
3
4
5
6
7
8
9
10
11
12
13
14
15
16
17
18
19
20
21
22
23

PROCESS FOR THE PURIFICATION OF A DIOLEFIN HYDROCARBON STREAM FROM A NAPHTHA STEAM CRACKER

BACKGROUND OF THE INVENTION

The field of art to which this invention pertains is the purification of a diolefin hydrocarbon stream produced in a naphtha steam cracker and containing trace quantities of undesirable acetylene compounds. The production of diolefins by means of naphtha cracking processes is well known and widely practiced to produce a wide variety of products and precursor products. Most of these diolefin production processes produce undesirable trace quantities of acetylene. One technique which is used to purify diolefin streams selectively hydrogenates the acetylene compounds while minimizing the destruction or hydrogenation of the diolefin compounds.

The selective hydrogenation of the acetylene compounds is generally conducted in the presence of a selective hydrogenation catalyst and hydrogen and conducted at an elevated pressure and temperature. Such selective hydrogenation catalysts are well known in the art and include, for example, a catalyst containing copper metal associated with one or more activator metals impregnated on an alumina support. During the acetylene hydrogenation polymers are formed and deposited on the catalyst thereby reducing the activity of the catalyst. One known method of regenerating spent or partially spent catalyst is to perform a controlled carbon bum and subsequent metal reduction to remove catalyst contaminants which are formed as an undesirable by-product of the acetylene hydrogenation. The carbon burn regeneration techniques necessarily require that the reaction zone containing the spent catalyst be taken off-line and that ancillary regeneration equipment be provided.

INFORMATION DISCLOSURE

U.S. Pat. No. 3,634,536 (Frevel et al) discloses a process for selectively hydrogenating acetylenic impurities in an isopropene- or butadiene-containing stream whereby carbon monoxide is utilized during hydrogenation over a copper-based catalyst.

U.S. Pat. No. 4,440,956 (Couvillion) discloses a catalyst for the removal of acetylenes from liquid hydrocarbon streams with a minimum loss of diolefinic unsaturation present in the liquid composition.

Although a wide variety of process flow schemes, operating conditions and catalysts have been used in commercial activities, there is always a demand for new selective hydrotreating processes which provide lower costs, higher selectivity and longer on-stream operation.

The present invention is able to maintain the high activity of the selective hydrogenation catalyst by discontinuing the flow of diolefinic hydrocarbon feedstock to at least one off-line hydrogenation reaction zone and contacting the at least partially spent catalyst with hydrogen and a stream containing naphtha in order to recover at least a portion of the lost activity.

BRIEF SUMMARY OF THE INVENTION

The present invention is a process for the purification of a diolefin hydrocarbon stream produced in a naphtha steam cracker to produce a high quality diolefin hydrocarbon stream having extremely low levels of acetylene over an extended period because of the ability to readily regenerate catalyst contained in an off-line selective hydrogenation reaction zone while continuing to operate an on-line selective hydrogenation reaction zone. The spent or partially spent catalyst is contacted with hydrogen and a stream containing naphtha in order to restore at least a portion of the fresh catalyst activity. The naphtha in combination with hydrogen is unexpectedly able to remove deactivating polymers and a dragstream of naphtha containing polymers is able to be admixed with the naphtha feedstock to the steam cracker in order to satisfactorily dispose of the polymers while simultaneously reclaiming useful hydrocarbons.

In accordance with one embodiment, the present invention relates to a process for the purification of a diolefin hydrocarbon stream from a naphtha steam cracker and containing trace quantities of acetylene compounds and the cyclic regeneration of an at least partially spent selective hydrogenation catalyst which process comprises: (a) introducing a naphtha feedstock and a recycle stream comprising naphtha and polymer compounds into a naphtha steam cracker to produce a diolefin hydrocarbon stream containing trace quantities of acetylene compounds; (b) passing the diolefin hydrocarbon stream containing trace quantities of acetylene compounds and elemental hydrogen into a selective hydrogenation zone to selectively hydrogenate at least a portion of the acetylene compounds and to produce an at least partially spent selective hydrogenation catalyst; (c) passing the resulting effluent from the selective hydrogenation zone in step (b) to a fractionation zone to produce a diolefin hydrocarbon stream having a reduced concentration of acetylene compounds; (d) contacting the at least partially spent selective hydrogenation catalyst in the selective hydrogenation zone with a stream comprising naphtha and hydrogen to reduce the polymer content of the selective hydrogenation catalyst to thereby increase hydrogenation activity; (e) passing the resulting effluent from the selective hydrogenation zone in step (d) to the fractionation zone to produce a stream comprising naphtha and polymer compounds; (f) recycling at least a portion of the stream comprising naphtha and polymer compounds to provide at least a portion of the stream comprising naphtha and hydrogen in step (d); (g) recycling at least another portion of the stream comprising naphtha and polymer compounds to step (a); (h) recovering the diolefinic hydrocarbon stream having a reduced concentration of acetylene compounds produced in step (c); and (i) reintroducing the diolefin hydrocarbon stream containing trace quantities of acetylene compounds and elemental hydrogen into the selective hydrogenation zone after contact and extraction with the stream comprising naphtha and hydrogen.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

It has been discovered that a diolefin hydrocarbon stream from a naphtha steam cracker may be purified in an economical and facile manner by integrating the naphtha steam cracker with a selective hydrogenation process for the selective hydrogenation of trace quantities of acetylene contained in a stream of diolefins from the steam cracker. The selective hydrogenation zone is fed a raw diolefin stream preferably containing about 50 weight percent butadiene and about 0.8 weight percent acetylene which is a typical butadiene stream produced in a naphtha steam cracker. Any entrained or condensed water is preferably removed or decanted from the raw butadiene stream. Long term high activity, good yields and product quality is achieved by contacting an off-line reaction zone containing the selective hydrogenation catalyst with hydrogen and a naphtha stream which is preferably a slipstream of fresh naphtha feedstock charged to the naphtha steam cracker. Simultaneously, at least one other reaction zone containing the selective hydrogenation catalyst remains on-line in order to maintain the continuous production of a hydrogenated diolefin stream having a reduced concentration of acetylene compounds. These advantages enable superior performance and economic results.

The process of the present invention is particularly useful for the production of high quality diolefin streams in a process having an extended on-stream capability. The diolefin feed stream is produced in any known conventional naphtha steam cracker and which stream contains undesirable trace quantities of acetylene compounds. It is contemplated that the diolefin feedstream from the naphtha steam cracker contains diolefins containing from 3 to about 5 carbon atoms. A preferred diolefin feedstream contains butadiene.

In accordance with the present invention, the diolefin stream from the naphtha steam cracker is introduced along with hydrogen into an on-line selective hydrogenation reaction zone operating at selective hydrogenation conditions and containing a selective hydrogenation catalyst to produce an improved diolefin stream having a reduced concentration of acetylene compounds. The selective hydrogenation conditions will depend upon the particular composition of the diolefinic feed and may preferably be selected from a pressure from about 200 psig to about 500 psig and a temperature from about 90° F. to about 180° F.

In an alternating fashion, an off-line reaction zone containing selective hydrogenation catalyst, either spent or partially spent, is preferably contacted with a stream containing naphtha and hydrogen at catalyst regeneration conditions including a pressure from about 150 psig to about 500 psig, a temperature from about 90° F. to about 500° F. and a naphtha solvent liquid hourly space velocity from about 0.5 to about 10 $hr^{-1}$. The naphtha solvent may be selected from any compound or mixtures of hydrocarbon compounds boiling in the range of naphtha and which naphtha solvent is capable of acting as a solvent for polymers which are produced during the selective hydrogenation reaction. Suitable naphtha solvents may be selected from alkane compounds having from about 4 to about 8 or more carbon atoms boiling in the range of naphtha. In the case where the diolefin stream is a stream of butadiene, a particularly preferred naphtha solvent contains compounds having at least six carbon atoms. It is preferred that the naphtha solvent has a boiling point greater than the diolefin feedstream. The resulting effluent containing naphtha solvent, dissolved polymer and hydrogen from the off-line reaction zone undergoing regeneration is introduced into a fractionation zone to remove gaseous hydrogen and to recover the naphtha solvent which is preferably recycled together with fresh, make-up naphtha solvent. A small drag stream containing naphtha solvent and polymer is removed from the regeneration loop in order to prevent an undesirable buildup of polymer and is charged to the naphtha steam cracker as a feedstock. The fresh make-up of naphtha solvent is added to the regeneration loop in order to maintain a suitable inventory of naphtha solvent At least a portion of the naphtha solvent recovered from the fractionation zone is preferably recycled to the inlet of the off-line selective hydrogenation zone.

The resulting effluent from the on-line selective hydrogenation reaction zone is passed to a fractionation zone to produce a diolefin hydrocarbon stream having a reduced concentration of acetylene compounds and a stream containing polymer compounds which are recovered and removed from the process.

The selective hydrogenation catalyst may be any suitable known catalyst and may contain one or more beds of the same or different selective hydrogenation catalyst. Suitable catalysts for the selective hydrogenation of acetylene preferably contain copper metal, activated with one or more of the metals from the group of silver, platinum, palladium, manganese, cobalt, nickel, chromium and molybdenum on an alumina support. The hydrogenation catalysts contemplated for use in the process of the present include any support types, sizes and shapes, for example, spheres, cylinders, tri-lobes, quadralobes and rings. The process of the present invention is not limited by the type of hydrogenation catalyst and any suitable selective hydrogenation catalyst is contemplated for use therein.

DETAILED DESCRIPTION OF THE DRAWING

In the drawing, the process of the present invention is illustrated by means of a simplified schematic flow diagram in which such details as instrumentation, heat-exchange, and heat-recovery circuits, separation facilities and similar hardware have been deleted as being non-essential to an understanding of the techniques involved.

With reference now to the drawing, a feedstream containing naphtha boiling range hydrocarbons is introduced into the process via conduit 1 and a portion thereof is transported via line 3 and is admixed with a hereinafter described recycle stream provided by line 22 and the resulting admixture is introduced via line 4 into naphtha steam cracker 5. A diolefin hydrocarbon stream containing acetylene is removed from naphtha steam cracker 5 via line 6 and introduced into selective hydrogenation zone 10. A stream containing ethylene, a stream containing propylene and a stream containing pyrolysis gas is removed from naphtha steam cracker 5 via lines 7, 8, and 9, respectively, and recovered. A resulting diolefin hydrocarbon stream containing a reduced concentration of acetylene compounds is removed from selective hydrogenation zone 10 via 11 and is transported via line 13 into fractionation zone 14. A high purity stream containing diolefin hydrocarbons is removed from fractionation zone 14 via line 23 and recovered for subsequent use. At least a portion of the naphtha feedstock to the process is transported via line 2 and is introduced into surge drum 17. A regeneration solvent containing naphtha and a relatively low concentration of polymers is removed from surge drum 17, transported via line 18, is admixed with hydrogen provided via line 19 and is introduced by line 20 into off-line selective hydrogenation zone 21. A polymer solvent containing naphtha and polymers removed from the catalyst in off-line selective hydrogenation zone 21 is removed via line 12 and is introduced via line 13 into fractionation zone 14. A solvent stream containing naphtha and polymers is removed from the bottom of fractionation zone 14 via line 15 and is introduced via line 16 into surge drum 17. At least a portion of the solvent containing naphtha and polymers is removed from the bottom of fractionation zone 14 via line 15 and is transported via line 22 and is introduced subsequently by line 4 into naphtha steam cracker 5 as hereinabove described.

The process of the present invention is further demonstrated by the following illustrative embodiment. This illustrative embodiment is, however, not presented to unduly limit the process of this invention, but to further illustrate the advantages of the hereinabove-described embodiment. The following results were not obtained by the actual performance of the present invention but are considered prospective and reasonably illustrative of the expected performance of the invention based upon sound engineering calculations.

ILLUSTRATIVE EMBODIMENT

A raw butadiene stream in an amount of 100 mass units and having the characteristics presented in Table 1 and produced in a naphtha steam cracker is admixed with 1 mass unit of hydrogen and the resulting admixture is introduced into a fixed bed of selective hydrogenation catalyst contained in an on-line hydrogenation zone. The catalyst contains copper metal. The resulting effluent from the on-line selective hydrogenation zone is introduced into a fractionation zone to produce a butadiene stream containing less than 3 wppm acetylene compounds (a 99.9% reduction).

An off-line selective hydrogenation zone containing a selective hydrogenation catalyst having a copper metal component is contacted with a stream containing naphtha and hydrogen at regeneration conditions including a pressure of 280 psig, a temperature of 300° F. and a liquid hourly space velocity (LHSV) of 1.3 $hr^{-1}$. The resulting effluent containing naphtha, hydrogen and polymer compounds from the off-line selective hydrogenation zone is also introduced into the previously mentioned fractionation zone to produce a stream containing naphtha and dissolved polymer compounds. At least a portion of the recovered naphtha in an amount of 0.35 mass units is removed from the regeneration section as a drag stream to prevent undue polymer compound accumulation and forwarded to the steam cracker as a valued feedstock component. At least another portion of the recovered naphtha is recycled along with fresh make-up naphtha in an amount of 0.3 mass units to the off-line selective hydrogenation zone in order to continue the regeneration thereof.

TABLE 1

| RAW BUTADIENE STREAM ANALYSIS |
|---|
| Butadiene 50 weight % |
| Acetylene 0.8 weight % |

The foregoing description, drawing and illustrative embodiment clearly illustrate the advantages encompassed by the process of the present invention and the benefits to be afforded with the use thereof.

What is claimed:

1. A process for the purification of a diolefin hydrocarbon stream from a naphtha steam cracker and containing trace quantities of acetylene compounds and the cyclic regeneration of an at least partially spent selective hydrogenation catalyst which process comprises:

(a) introducing a naphtha feedstock and a recycle stream comprising naphtha and polymer compounds into a naphtha steam cracker to produce a diolefin hydrocarbon stream containing trace quantities of acetylene compounds;

(b) passing said diolefin hydrocarbon stream containing trace quantities of acetylene compounds and elemental hydrogen into a selective hydrogenation zone to selectively hydrogenate at least a portion of said acetylene compounds and to produce an at least partially spent selective hydrogenation catalyst;

(c) passing the resulting effluent from said selective hydrogenation zone in step (b) to a fractionation zone to produce a diolefin hydrocarbon stream having a reduced concentration of acetylene compounds;

(d) contacting the at least partially spent selective hydrogenation catalyst in said selective hydrogenation zone with a stream comprising naphtha and hydrogen to reduce the polymer content of the selective hydrogenation catalyst to thereby increase hydrogenation activity;

(e) passing the resulting effluent from said selective hydrogenation zone in step (d) to said fractionation zone to produce a stream comprising naphtha and polymer compounds;

(f) recycling at least a portion of said stream comprising naphtha and polymer compounds to provide at least a portion of said stream comprising naphtha and hydrogen in step (d);

(g) recycling at least another portion of said stream comprising naphtha and polymer compounds to step (a);

(h) recovering said diolefinic hydrocarbon stream having a reduced concentration of acetylene compounds produced in step (c); and (i) reintroducing said diolefin hydrocarbon stream containing trace quantities of acetylene compounds and elemental hydrogen into said selective hydrogenation zone after contact and extraction with said stream comprising naphtha and hydrogen.

2. The process of claim 1 wherein said stream comprising naphtha boils in the range of about 100° F. to about 400° F.

3. The process of claim 1 wherein said selective hydrogenation zone contains a catalyst comprising copper metal.

4. The process of claim 1 wherein said selective hydrogenation zone is operated at conditions including a pressure from about 200 to about 500 psig and a temperature from about 90° F. to about 180° F.

5. The process of claim 1 wherein the contacting in step (d) is conducted at conditions including a pressure from about 150 to about 500 psig, a temperature from about 90° F. to about 500° F., and a liquid hourly space velocity from about 0.5 to about 10 $hr^{-1}$.

6. The process of claim 1 wherein said diolefin hydrocarbon stream comprises a compound selected from the group of diolefins containing from about 3 to about 5 carbon atoms.

7. The process of claim 1 wherein said diolefin hydrocarbon stream comprises butadiene.

* * * * *